US007623017B2

(12) United States Patent
Busweli

(10) Patent No.: US 7,623,017 B2
(45) Date of Patent: Nov. 24, 2009

(54) TOROIDAL INDUCTIVE DEVICES AND METHODS OF MAKING THE SAME

(76) Inventor: Harrie R. Busweli, 101 Holly Suite 3, Berea, KY (US) 40403

( * ) Notice: Subject to any disclaimer, the term of this patent is extended or adjusted under 35 U.S.C. 154(b) by 0 days.

(21) Appl. No.: 10/589,878

(22) PCT Filed: Feb. 28, 2005

(86) PCT No.: PCT/US2005/006063

§ 371 (c)(1),
(2), (4) Date: Jun. 5, 2007

(87) PCT Pub. No.: WO2005/086186

PCT Pub. Date: Sep. 15, 2005

(65) Prior Publication Data

US 2007/0279174 A1 Dec. 6, 2007

Related U.S. Application Data

(60) Provisional application No. 60/547,802, filed on Feb. 27, 2004.

(51) Int. Cl.
*H01F 27/28* (2006.01)

(52) U.S. Cl. ..... 336/229

(58) Field of Classification Search ..... 336/65, 336/83, 178, 212, 225, 229, 234, 23
See application file for complete search history.

(56) References Cited

U.S. PATENT DOCUMENTS

| | | | | |
|---|---|---|---|---|
| 4,138,783 | A | 2/1979 | Portier | |
| 4,652,771 | A | 3/1987 | Specht et al. | |
| 4,754,180 | A | 6/1988 | Kiedrowski | |
| 4,845,606 | A | 7/1989 | Herbert | |
| 5,400,005 | A | 3/1995 | Bobry | |
| 5,828,282 | A | 10/1998 | Tiemann | |
| 5,838,220 | A | 11/1998 | Hagberg | |
| 6,229,305 | B1 | 5/2001 | Logue | |
| 6,246,311 | B1 | 6/2001 | Finnemore et al. | |
| 7,218,196 | B2 * | 5/2007 | Nakao et al. | 336/83 |
| 7,289,013 | B2 * | 10/2007 | Decristofaro et al. | 336/233 |
| 2002/0003464 | A1 | 1/2002 | Berkcan et al. | |
| 2002/0033748 | A1 | 3/2002 | Bolotinsky et al. | |
| 2003/0080847 | A1 | 5/2003 | Radzelovage | |
| 2004/0090301 | A1 | 5/2004 | Berkcan et al. | |
| 2004/0140880 | A1 | 7/2004 | Haugs et al. | |

FOREIGN PATENT DOCUMENTS

| | | |
|---|---|---|
| WO | WO 00/33331 | 6/2000 |
| WO | WO 00/44006 | 7/2000 |
| WO | WO 02/059914 A2 | 8/2002 |

* cited by examiner

*Primary Examiner*—Tuyen Nguyen
(74) *Attorney, Agent, or Firm*—Miles & Stockbridge, P.C.

(57) ABSTRACT

A toroidal inductive device has an electrical winding component (11) of generally toroidal shape and discrete magnetic components (12) shaped as toric sections. The discrete magnetic components (12) are arranged on the electrical winding component such that the discrete magnetic components (12) are offset circumferentially from each other and at least partially embrace the electrical winding component (11). The magnetic components (12) define magnetic flux gaps in meridional planes. A method for forming a magnetic component is also provided wherein magnetic wire is wound onto a toroidal electrical winding component without the need for passing a spool through a central opening of the toroid.

11 Claims, 7 Drawing Sheets

TOROIDAL INDUCTIVE DEVICES AND METHODS OF MAKING THE SAME

CROSS-REFERENCE TO RELATED APPLICATION

This application claims the benefit of Provisional Application No. 60/547,802, filed Feb. 27, 2004, the entirety of which is incorporated herein by reference.

BACKGROUND OF THE INVENTION

1. Field of the Invention

The present invention relates to the field of toroidal inductive devices, and more particularly to toroidal inductive devices such as transformers, chokes, coils, ballasts, and the like.

2. Description of Related Art

Conventionally available toroidal inductive devices include a toroidal shaped magnetic portion (usually referred to as a core), which is made of strips of grain oriented steel, continuous strips of alloys, or various powdered core arrangements, surrounded by a layer of electrical insulation. An electrical winding is wrapped around the core and distributed along the circumference of the core. This may be done in a toroidal winding machine, for example. Depending upon the type of toroidal inductive device, an additional layer of electrical insulation is wrapped around the electrical winding and a second electrical winding is wound on top of the additional insulation. An outer layer of insulation is typically added on top of the second winding to protect the second winding unless the toroidal device is potted in plastic or the like. A representative toroidal inductive device is described in U.S. Pat. No. 5,838,220.

Toroidal inductive devices provide several key advantages over the more common E-I type inductive devices. For instance, the magnetic core shape minimizes the amount of material required, thereby reducing the overall size and weight of the device. Since the windings are symmetrically spread over the entire magnetic portion of the device, the wire lengths are relatively short, thus further contributing to the reduced size and weight of the device. Additional advantages include less flux leakage, less noise and heat, and in some applications higher reliability.

One significant shortcoming of conventional toroidal inductive devices is that the manufacturing costs far exceed those associated with the more common E-I type inductive devices. The costs are high because complex winding techniques are necessary to wind the electric windings around the toroidal shaped magnetic core.

An additional shortcoming of conventional toroidal inductive devices is that they have a vulnerability to high in-rush current. Such devices generally cannot provide controllable magnetic reluctance, because they are manufactured such that they have no control over a gap in the magnetic flux path. Investigation by the present inventor has revealed that although no gap control is apparent, the flux, which is circular and closed by definition, must pass through an effective gap created by the magnetic portion being spirally constructed and thus not integrally circular. See, for example, FIG. 6, which illustrates magnetic flux 80 in relation to a spiral magnetic member 120. Because the gap is distributed along a length of the magnetic material, the virtual or cumulative gap is very small and thus rendered inconsequential to the operation of the device. The gap is effectively so small that it is necessary in many cases to accommodate the current in-rush problem by adding protective circuitry, such as a current limiting resistor, to the basic device. This increases the overall cost of the device.

An alternative form of toroidal inductive device is known in which the arrangement of the electrical and magnetic portions is basically reversed from the common arrangement described above. In this alternative approach, a magnetic wire is helically wound onto a toroidal electrical winding such that the magnetic portion of the device is formed on the outside of the electrical portion. Such an arrangement is disclosed in International Patent Application Publication No. WO 00/44006. However, this arrangement also requires the use of complex winding techniques and suffers from a lack of magnetic gap control.

SUMMARY OF THE INVENTION

The present invention provides toroidal inductive devices and methods of manufacture that have been devised in view of the aforementioned deficiencies of the prior art.

In the present inventor's U.S. Patent Application Publication No. 2004/0066267 A1, the entirety of which is incorporated herein by reference, a technique is disclosed in which a plurality of discrete magnetic components are arranged on a generally toroidal electrical winding component, with each magnetic component preferably at least partially embracing the electrical winding component so as to complete a magnetic flux path and having end portions arranged to form at least one magnetic flux gap. The electrical winding component may include one or more electrical windings, for example.

In accordance with one principal aspect of the present invention, such discrete magnetic components are formed as toric sections, preferably as wedge-shaped groups or bundles of magnetic wire which are sliced or cut through so that they may be spread open and fitted around the electrical winding component. Such magnetic components can be produced by winding the magnetic wire about a form or jig configured as a toric section generally corresponding to a section of the electrical winding component. The wound magnetic component is then sliced or cut through such that it can be spread open in a meridional plane, allowing for easy removal from the jig and placement onto the toroidal electrical winding component. The end portions formed by cutting the magnetic component define a magnetic flux gap which can be readily controlled, such as by controlling one or more of the width, direction, and orientation of the of the cut through the magnetic component. Gap control can also be achieved by appropriate selection of the inner circumferential dimension of the magnetic component relative to the outer circumferential dimension of the toroidal electrical winding component in a meridional plane.

The present invention more generally provides a toroidal inductive device in which the magnetic portion comprises a plurality of magnetic components that are constructed to be toric sections such that, once they are formed, they can be sliced and thereafter placed around the generally toroidal electrical winding component. The magnetic components may partially, but will preferably entirely, encase the electrical winding component, which may include one or more electrical windings.

In accordance with another of its principal aspects, the present invention provides an improved method of forming the magnetic portion of a toroidal inductive device by winding magnetic wire onto the electrical winding component. This method, in contrast to conventional winding in a continuous helical path, utilizes a sewing-like action to wrap and, if desired, completely envelop the electrical winding component with magnetic wire which will form the magnetic portion of the inductive device. In an exemplary embodiment, a hook engages a magnetic wire being fed from a spool to pull the magnetic wire partially around the electrical winding component. The electrical winding component is then moved to a second position, allowing the hook to reach past the electrical winding component and engage the magnetic wire again, thereby tightening the wire around the electrical winding component and pulling a second portion of magnetic wire partially around the electrical winding component. This process is repeated as the toroidal electrical winding component is rotated on its axis, preferably until it is at least substantially completely covered with magnetic wire that is knitted together and completing a magnetic path that the flux can follow as it emanates from the electrical winding component.

BRIEF DESCRIPTIONS OF THE DRAWINGS

The foregoing and other aspects, features and advantages of the present invention will be more fully appreciated from the following description of the preferred embodiments, taken with reference to the accompanying drawings, wherein.

Figure 7A:
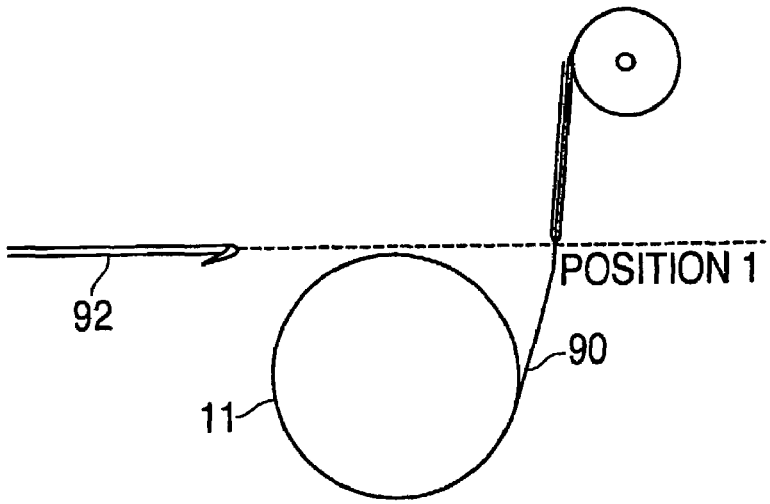
Figure 8A:
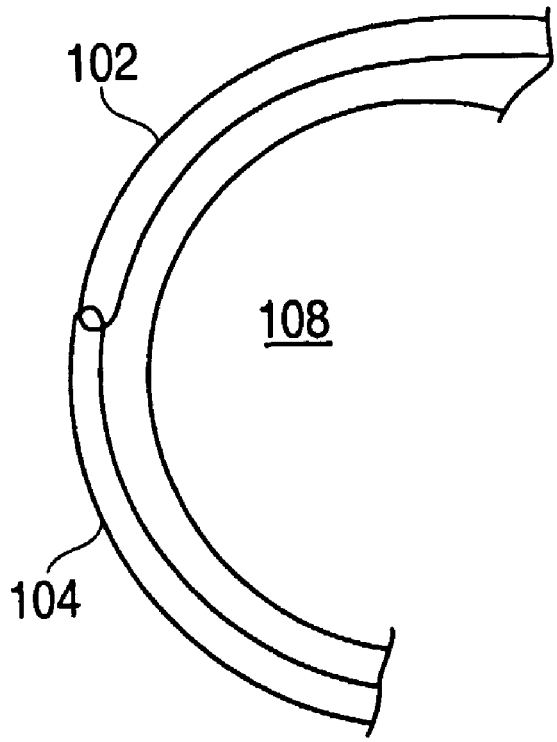
Figure 8B:
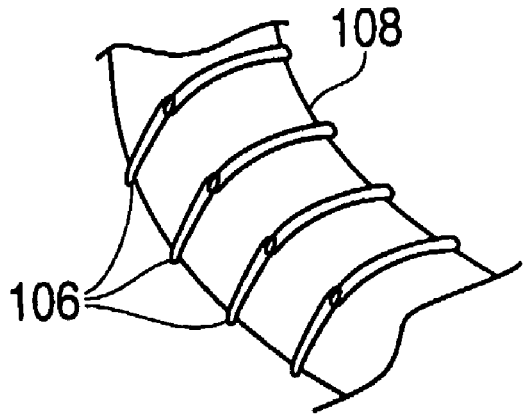

FIGS. 7A *to*7C illustrate an exemplary time sequence of steps showing a "sewing" method for placing a magnetic wire on an electrical winding component;

FIGS. 8A and 8B are additional views showing magnetic wire sewn upon a toroidal electrical component.

DETAILED DESCRIPTION

Figure 1:
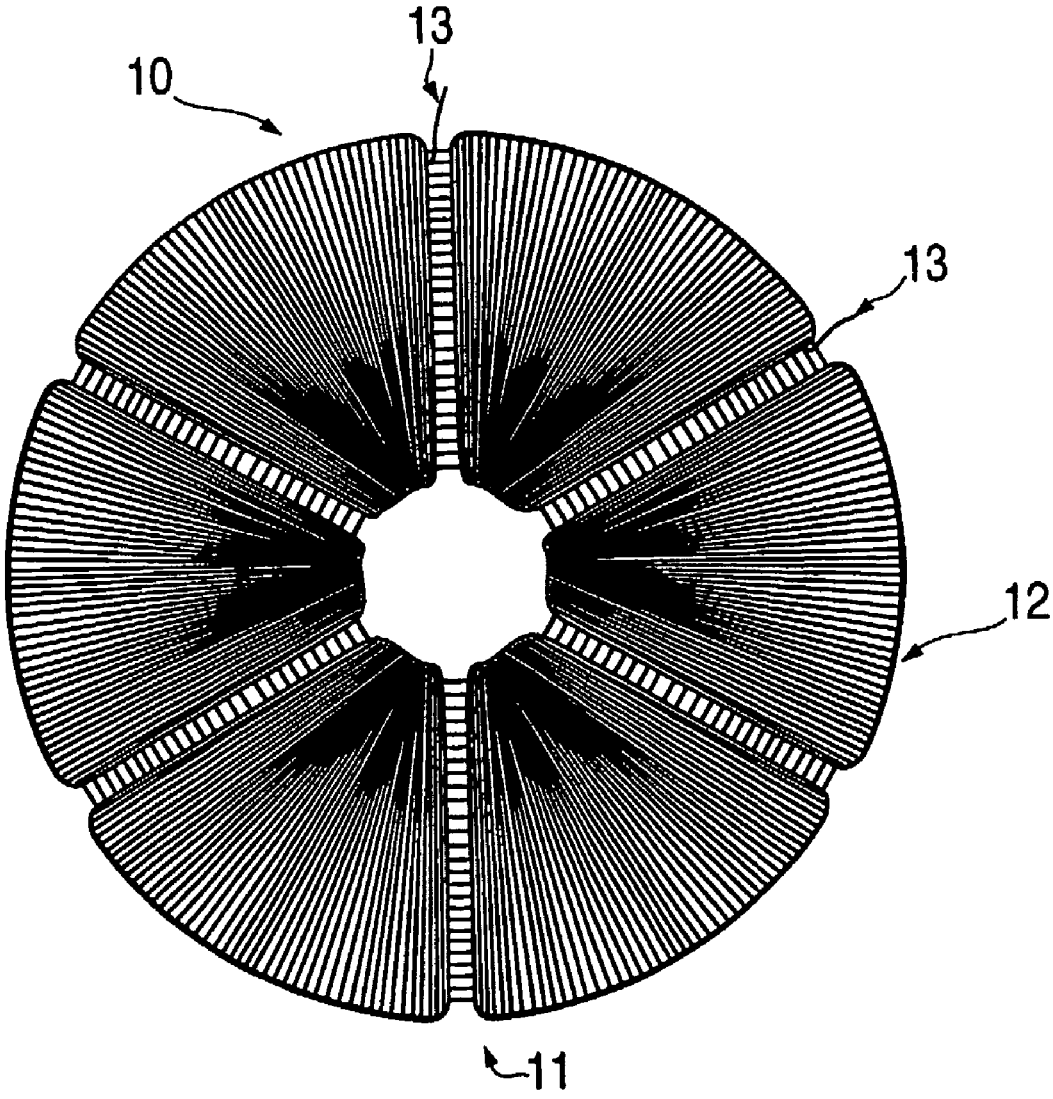
FIG. 1 is a diagrammatic perspective view of an exemplary toroidal inductive device with a plurality of magnetic components placed on a toroidal electrical winding component.

FIG. 1 is a diagrammatic perspective view of a toroidal inductive device 10 in accordance with the present invention. An electrical winding component 11 of the device is generally toroidal in form and may include one or more electrical windings as described in the aforementioned U.S. Patent Application Publication No. 2004/0066267 A1. In the form shown, a plurality of magnetic components 12 are placed at circumferentially spaced positions along the electrical winding component so as to partially envelop the electrical winding component. The electrical winding component may have leads 13 that egress from within the toroidal inductive device through a gap or gaps between one or more adjacent pairs of magnetic components 12.

Each of the magnetic components 12 generally has the form of a toroidal section and is preferably made of magnetic wire. The magnetic wire may be of circular cross-section or any other cross-section as desired for a particular application. Even flat wire can be used. Magnetic ribbon can also be used.

Each magnetic component 12 is preferably formed by winding the magnetic wire (or ribbon, if applicable) onto a form or jig that allows the wire to assume the desired geometric shape. For example, the jig may be in the shape of a toric section with a cross-sectional diameter in a meridional plane that is slightly larger than the cross-sectional diameter of the electrical winding component in a meridional plane. The wire is wound in a bundle having the shape of a toric section. The wire turns of the wound bundle may, if desired, be secured together by any suitable means such as magnetic adhesive, glue, tape, bands, etc. Next, the magnetic wire bundle wound on the jig is cut or sliced through such that the cut ends 15, 16 of the bundle can be spread open in order to facilitate removal from the jig and placement of the magnetic component onto the electrical winding component. The toric-section shaped magnetic component is placed on the toroidal form of the electrical winding component by spreading the cut ends and inserting the magnetic component over the electrical winding component, after which cut ends are brought substantially back together to form a desired magnetic flux gap. Depending on the gap requirements of a particular application, the cut ends of the installed magnetic component may be spaced, they may butt together or they may overlap, in a meridional plane. In a given inductive device, different magnetic components may have their cut ends similarly arranged, or combinations of spacing, butting, and overlapping ends may be used. The foregoing technique can also be applied using magnetic ribbon instead of wire.

The modular magnetic components are placed about the electrical winding component until the latter is at least partially enveloped by the magnetic components, which collectively constitute the magnetic portion of the device. The leads from the electrical winding component are allowed to pass through one or more gaps between the modular magnetic components. Additionally, other elements of the inductive device may pass between the modular magnetic components, such as cooling fins, cooling pipes, or channels to allow heat dissipation more readily from the electrical winding component and the inner regions of the magnetic components as may be desirable. The cooling pipes, cooling fins, or cooling channels may be located at least partially adjacent to and/or within one or both of the electrical winding component and the magnetic portion of the device.

Figure 1A:
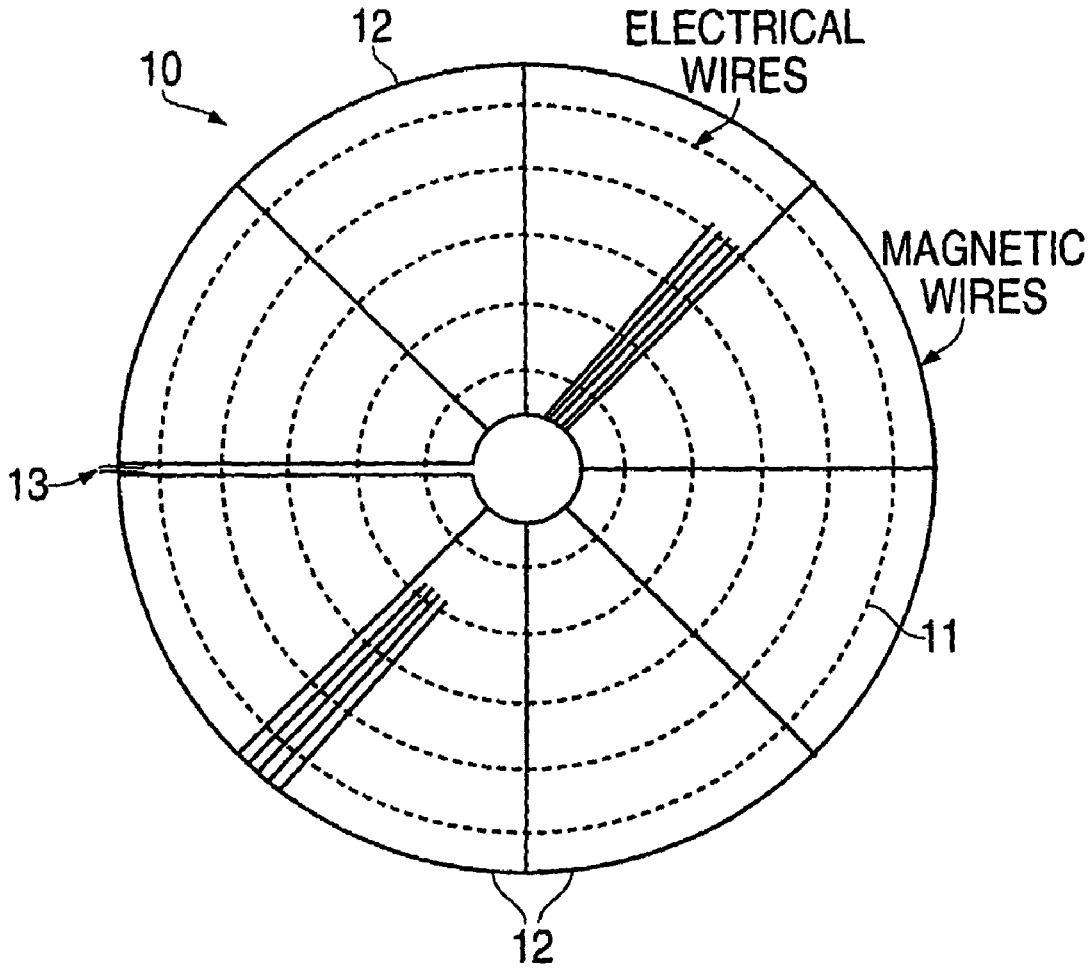
FIG. 1A is a diagrammatic plan view showing a variation of the device illustrated in FIG. 1.
Figure 1B:
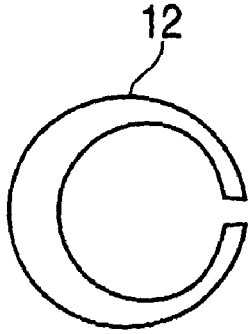
FIG. 1B is a diagrammatic view of a toroidal-section shaped magnetic component in a meridional plane.

In the illustrative form of FIG. 1, the magnetic components 12 are spaced circumferentially of the toroidal electric winding component. However, the magnetic components can also be abutted or even overlapped circumferentially of the electrical component to achieve more complete coverage of the electrical winding component by the magnetic portion thus formed, thereby enhancing the magnetic characteristics of the device. For example, the electrical component can be completely encased by the magnetic portion of the device with the exception of a small space between a single pair of magnetic components to accommodate the passage of the electrical leads to the electrical winding component, as shown in FIG. 1A. To facilitate both coverage of the electrical component and overall compactness of the finished device, the magnetic components are preferably formed to have a wedge shape or substantially a circular sector shape, with outwardly diverging sides in plan view as shown in FIG. 1 A. This will result in an increasing thickness of the wire bundle of each magnetic component toward the central hole of the toroidal electrical winding component (see also FIG. 1 B) , and consequently more efficient utilization of the space within the hole to accommodate magnetic material, thereby allowing for a more compact device.

Figure 2:
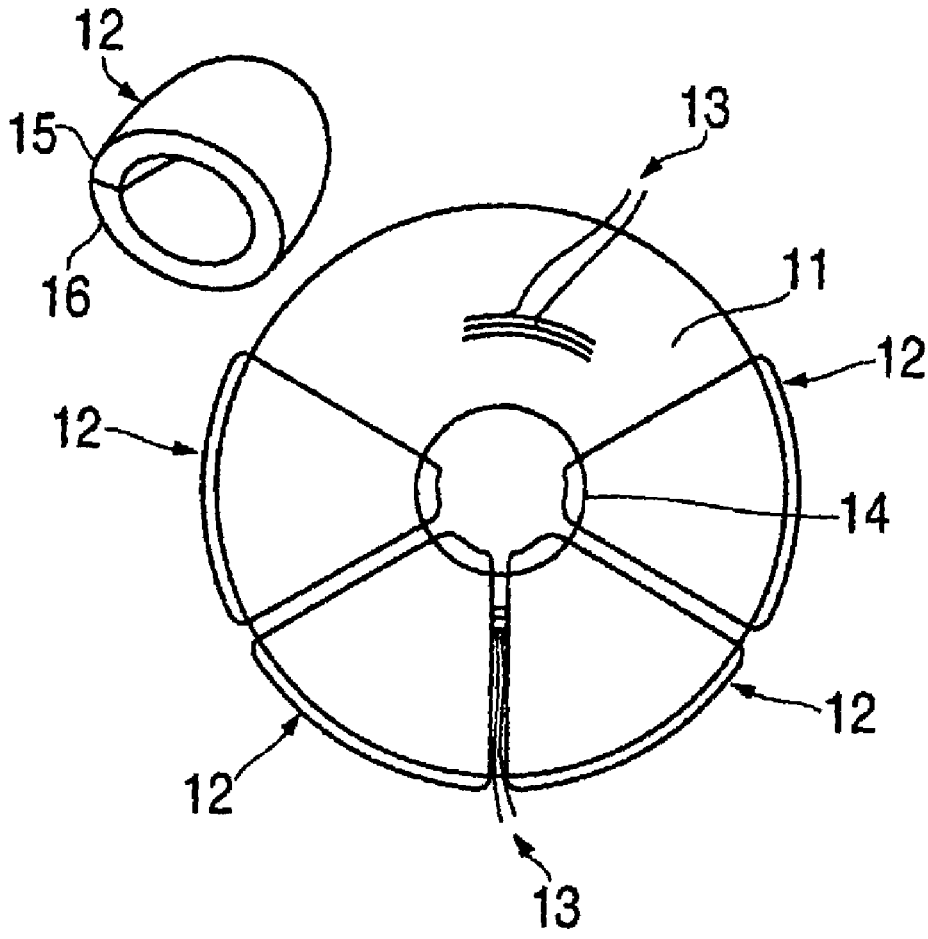
FIG. 2 shows a partially constructed toroidal inductive device with magnetic components placed on the electrical winding component and also showing, in perspective, a magnetic component prepared for placement about the electrical winding component.

FIG. 2 shows a toroidal inductive device, in partially assembled form, using modular magnetic components having a generally toric sectional shape. The electrical winding component 11 has several magnetic components 12 placed on it. An additional magnetic component 12 is shown not yet placed on the electrical component 11. As shown in FIG. 2, the magnetic component 12 has been sliced through at the portion corresponding to the outer circumference of the toroid to create two ends 15, 16 which can be spread apart to allow for insertion of the component 12 over the component 11 as previously explained. In practice of the invention, magnetic component ends 15, 16 may be butted, overlapped, or spaced once the magnetic component 12 has been placed about the electrical core 11. Each magnetic component 12 is wedge shaped as earlier described and is therefore thicker at the inner circumferential portion within the toroid interior opening and thinner at the outer circumferential portion of the toroid. The inner circumferential portion of the magnetic component 12 is indicated in FIG. 2 by number 14. The thicker inner circumferential portion 14 is created in winding the magnetic wire around the jig to form the magnetic component 12, wherein the wire gathers toward the inner circumference of the generally toroidal sectional jig. Electrical interface wires 13 egress from the inner portion of the toroidal inductive device via gaps between magnetic components 12. However, it should be appreciated that any suitable method that allows connection to the electrical component can be used.

Referring again to FIGS. 1, 1A and 2, each of the magnetic components 12, in tie form shown, is a bundle of magnetic wires or magnetic ribbons, which, in plan view, has an inner peripheral portion and an outer peripheral portion and opposite sides diverging from respective spaced ends of the inner peripheral portion to respective spaced ends of the outer peripheral portion, and has an area defined by the inner and outer peripheral portions and the opposite sides that is substantially covered with a multiplicity of the magnetic wires or magnetic ribbons extending between the inner peripheral portion and the outer peripheral portion. As shown in FIG. 1, the discrete magnetic components 12 are arranged as a series that substantially covers the electric winding component, with the inner peripheral portions adjacent to a hole and the outer peripheral portions adjacent to a perimeter of the inductive device.

Figure 3A:
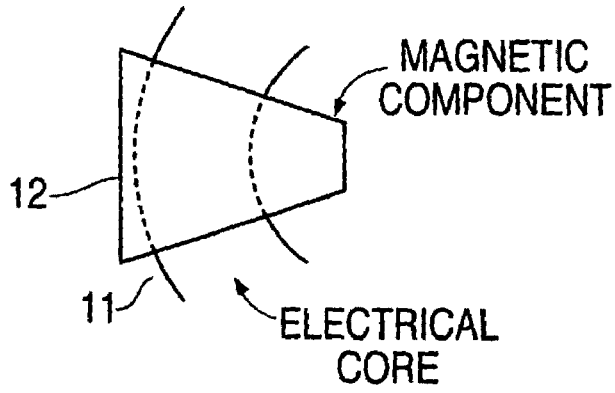
FIGS. 3A-3E are diagrams for explaining the slicing of toric-section shaped magnetic components.
Figure 3B:
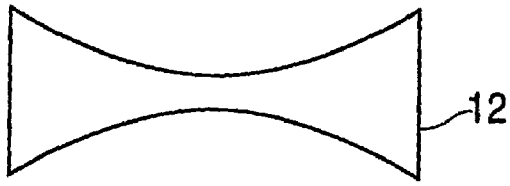
Figure 3C:
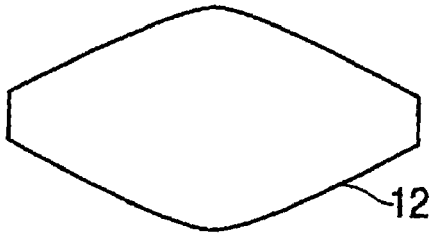
Figure 3D:
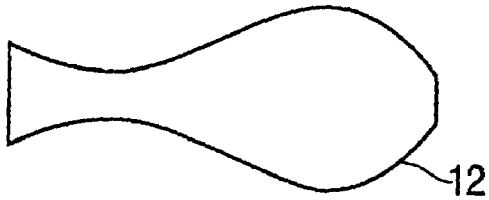
Figure 3E:
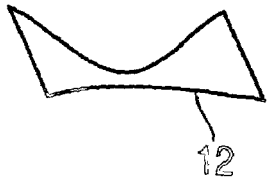

FIGS. 3A to 3E are views for explaining various ways in which the toric-section shaped magnetic components 12 can be sliced. FIG. 3A shows a plan view of a magnetic component 12 arranged on an electrical core 11. FIG. 3B shows a development view of a magnetic component 12, cut or sliced along a portion corresponding to the outer circumference of the toroid, and laid flat. FIG. 3C shows a shows a similar view of a magnetic component 12 cut at a portion corresponding to the inner circumference of the toroid. FIG. 3D shows a similar view of a magnetic component 12 cut in a location between those of FIGS. 3B and 3C. FIG. 3E shows a similar view of a magnetic component 12 cut obliquely. By use of different cuts or slices for different magnetic components, the positions of the respective gaps may be varied from one component to another if desired, to adjust the magnetic characteristics.

Figure 4:
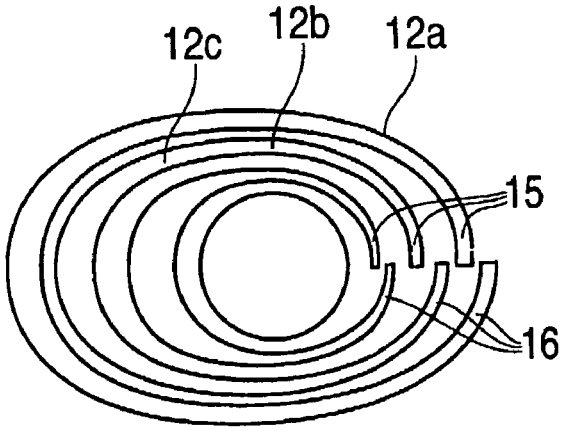
FIG. 4 is a diagrammatic cross-sectional view showing a portion of toroidal inductive device of the invention constructed with magnetic components arranged one upon another.

FIG. 4 is a cross-sectional view showing one side of a toroidal inductive device constructed using the method of the present invention, the cross-section being taken in a meridional plane containing the central axis of the toroid. Magnetic components 12*a*-12*c* are shown placed concentrically, one upon another, about the electrical winding component 11. The magnetic components 12*a*-12*c* are shown with respective pairs of cut ends 15, 16 overlapping. In this exemplary embodiment of the invention, the respective pairs of ends of the magnetic components 12*a*-12*c* are aligned along the cross-sectional circumference of the core. In an alternative embodiment of the invention, the overlapping pairs of ends 15, 16 can be placed in different positions circumferentially of the cross-section of the core.

Figure 5:
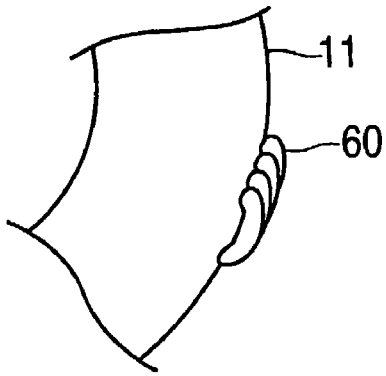
FIG. 5 shows an arrangement having a matrix of magnetic wire segments placed on the electrical winding component prior to a magnetic component being placed thereon.
Figure 6:
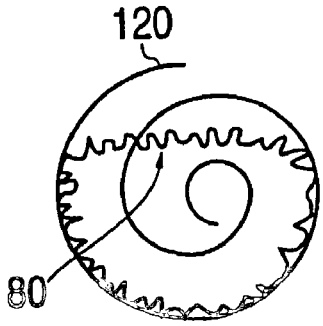
FIG. 6 is a diagram illustrating the magnetic flux path in a conventional helical magnetic component.

FIG. 5 shows another embodiment of the invention, wherein a matrix of magnetic wire segments 60 is placed (through intervening insulation) on the electrical winding component 11 prior to the magnetic components (not shown) being placed thereon with their cut ends disposed over the wires 60. This matrix of wire segments placed on the electrical component further enhances the flux coupling (i.e., decreases effective gap) of the magnetic components as installed.

If desired, wires, ribbons, etc. of different materials with different magnetic characteristics can be used to form a magnetic component 12, such that the effectiveness of the finished inductive device is enhanced across the entire operating range from quiescent to maximum operation. Yet another advantage of the present invention is that the construction and arrangement of the magnetic portions about the electrical core can provide for substantially homogenous, balanced and symmetrical paths for both the magnetic flux and the electrical current to pass through the magnetic portion and the electrical portion, respectively, thus greatly reducing or even eliminating hot-spot generation. Further still, this homogeneity serves to minimize flux path aberration, resulting in less harmonic distortion which further discourages the generation or amplification of undesirable frequency components within the generally toroidal shaped inductive device.

Figure 7B:
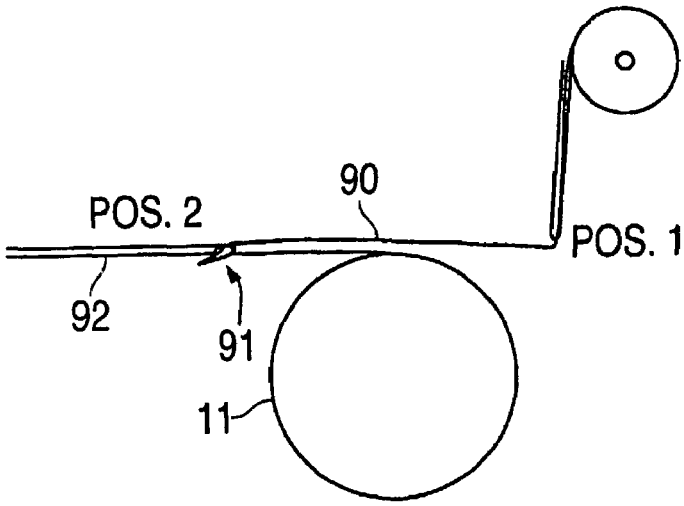
Figure 7C:
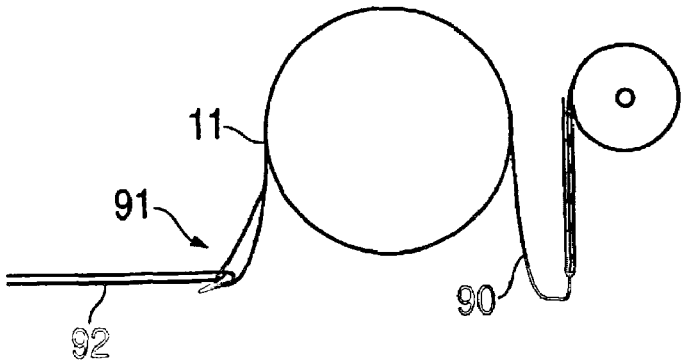

Turning to the second principal aspect of the invention, FIGS. 7A-C show a time sequence of a method of manufacturing a toroidal inductive device by means of "sewing" action, wherein a magnetic wire is engaged and manipulated by hook for wrapping on a toroidal electrical winding component 11. FIG. 7A shows the electrical winding component 11 with a spool or supply S of magnetic wire 90 having an end passed through a guide G (e.g., in the form of a tube) and secured to the component 11 by any suitable means. A hook 92 for pulling the wire 90 around the electrical component has not yet engaged the magnetic wire. This is the initial condition of the method of manufacture. FIG. 7B shows that the hook has engaged the magnetic wire 90 from position 1, which is above the central hole of the toroidal component 11, and has pulled the wire to position 2, thereby pulling a length of magnetic wire 90 partially around the electrical component 11 land forming a loop portion 91 which passes around the hook. In FIG. 7C the hook 92 has remained stationary while the electrical component 11 has been moved upwards. This causes the looped magnetic wire 90 to pass further around the electrical component 11. In a further step, not shown, the hook once again engages the magnetic wire coming from the feeder spool and pulls a further loop of the magnetic wire underneath the electrical winding component, in a manner similar to FIG. 7A, and back through the first loop 91. To avoid snagging the first loop 91, the hook may be rotated on its axis to position the free end such that it will pass through the interior of the first loop. Alternatively, the free end of the hook can be constructed as an articulated finger which can be moved from an open position for catching the wire 90 to a closed position to define an eyelet which can readily pass through the first loop 91. The electrical component is next moved back down such that the second portion of magnetic wire that was underneath the electrical component passes upward around the bottom side of the electrical component cross-section, forming another loop similar to loop 91 above the exterior such that the hook can again engage the magnetic wire and pull a portion of the magnetic wire across the top of the electrical core, as in FIGS. 7A and 7B. In this way, one loop catches the next, and the magnetic wire encircles and is pulled tight against the electrical component. The steps described above are repeated while the electrical component is rotated on its central axis, allowing for the partial or full coverage of the electrical component with the magnetic wire.

The magnetic flux in a toroidal inductive device constructed in the above-described manner travels around the electrical component along marginal planes, completing a circular path. The flux passes across the junctions of the magnetic wire where the wire changes direction and is attached by one loop catching another. In this arrangement, an effective gap is provided at the looping points. Because the arrangement of loops-catching-loops is slightly more bulky than a conventional wire winding, and because of flux leakage in the gaps thus created, it may be preferred to stagger the loop catchment points rather than having them all at the same position about the cross-sectional circumference (meridional circumference) of the electrical component.

A noteworthy advantage of the above-described winding method lies in not having to pass a spool of wire through the central hole of the toroid. The central hole of the toroidal inductive device can therefore be made smaller and thus more nearly filled up with the wires which surround the toroidal electrical component, allowing for a more compact device. To increase processing speed, one or more additional hook and wire supply arrangements as above described can be utilized for placing magnetic wire upon different parts of the electrical component at the same time.

FIGS. 8A and 8B show additional views of magnetic wire sewn upon a toroidal electrical component 108. In particular, FIG. 8A shows a first magnetic wire portion 102 and a second magnetic wire portion 104 looped through each other. The first magnetic wire portion 102 and the second magnetic wire portion 104 may be portions of the same or different wires.

FIG. 8B shows multiple wires 106 looped and arranged on a toroidal form 108, the looping being similar to that shown in FIG. 8A.

In the looped wire arrangements described above, when the magnetic flux encounters the looped portions of the magnetic wires, the magnetic flux must leave the wire portion it is in and move to another wire portion to make a circle. The loop portions thus form an effective magnetic flux gap.

The foregoing description of the exemplary embodiments of the invention has been presented for purposes of illustration. It is not intended to be exhaustive or to limit the invention to the precise forms disclosed. It should be noted that toroidal inductive devices commonly have a classical donut shape, but other forms, such as annular cylindrical forms, are also well known and regarded as part of the general class of toroidal devices. References to generally toroidal or generally toric shapes herein are intended to include all such variations.

What is claimed is:

1. An inductive device, comprising:

an electrical winding component of generally toroidal shape; and a plurality of discrete magnetic components, each formed as a toric section bundle of magnetic wires or magnetic ribbons which is generally circular sector-shaped in plan view and at least partially embracing said electric winding component to complete a magnetic flux path in a meridional plane and further having end portions arranged to form at least one magnetic flux gap in the meridional plane.

2. The inductive device of claim 1, wherein the at least one magnetic flux gap is at a peripheral portion of each magnetic component.

3. The inductive device of claim 1, wherein each magnetic component is oval or circular in the meridional plane.

4. The inductive device of claim 1, wherein the bundle is thicker at an inner peripheral portion than at an outer peripheral portion.

5. The inductive device of claim 1, wherein, in plan view, the bundle has an inner peripheral portion and an outer peripheral portion and opposite sides diverging from respective spaced ends of the inner peripheral portion to respective spaced ends of the outer peripheral portion, and has an area defined by the inner and outer peripheral portions and the opposite sides that is substantially covered with a multiplicity of the magnetic wires or magnetic ribbons extending between the inner peripheral portion and the outer peripheral portion.

6. The inductive device of claim 5, wherein, in plan view, the discrete magnetic components are arranged as a series that substantially covers the electric winding component, with the inner peripheral portions adjacent to a hole and the outer peripheral portions adjacent to a perimeter of the inductive device, and with adjacent magnetic components spaced from one another, abutting one another, or overlapping one another.

7. A magnetic component, comprising:

a member constructed of a bundle of magnetic wires or magnetic ribbons arranged as a generally toric-section having a circular sector-shape in plan view defined by an inner peripheral portion and an outer peripheral portion and opposite sides that diverge from respective spaced ends of the inner peripheral portion to respective spaced ends of the outer peripheral portion, and constructed such that the member can at least partially embrace an electrical winding of generally toroidal shape; and a magnetic flux gap in a meridional plane of said member of magnetic material.

8. The magnetic component of claim 7, wherein the magnetic flux gap is at one of the peripheral portions of the member.

9. The magnetic component of claim 7, wherein the member is oval or circular in the meridional plane.

10. The magnetic component of claim 7, wherein the bundle is thicker at the inner peripheral portion than at the outer peripheral portion.

11. The magnetic component of claim 7, wherein, in plan view, the inner and outer peripheral portions and the opposite sides of the bundle define an area that is substantially covered by the magnetic wires or magnetic ribbons extending between the inner and outer peripheral portions.

* * * * *